US005599088A

United States Patent [19]

Chien

[11] Patent Number: 5,599,088

[45] Date of Patent: Feb. 4, 1997

[54] FLASHING FOOTWEAR LIGHT MODULE

[76] Inventor: Tseng L. Chien, 8F, No. 29, Alley 73, Liu-Shen Street, Shi-Chi Town, Taipei, Haeng, Taiwan

[21] Appl. No.: 517,502

[22] Filed: Aug. 21, 1995

[51] Int. Cl.[6] ..... F21L 15/06

[52] U.S. Cl. ..... 362/103; 362/276; 362/802; 36/137; 200/61.45 R

[58] Field of Search ..... 362/103, 200, 362/201, 251, 276, 800, 802; 36/137; 200/61.45 R, 61.48

[56] References Cited

U.S. PATENT DOCUMENTS

| | | | |
|---|---|---|---|
| 2,572,760 | 10/1951 | Rikelman | 362/103 |
| 2,634,407 | 4/1953 | Johnson | 340/321 |
| 2,849,819 | 9/1985 | Murphy et al. | 446/153 |
| 2,959,892 | 11/1960 | Johnson | 446/421 |
| 3,053,949 | 9/1962 | Johnson | 200/61.49 |
| 3,946,505 | 3/1976 | Dana, III | 362/103 |
| 4,158,922 | 6/1979 | Dana, III | 36/137 |
| 4,231,079 | 10/1980 | Heminover | 362/106 |
| 4,412,205 | 10/1983 | Von Kemenczky | 340/331 |
| 4,701,146 | 10/1987 | Swenson | 446/130 |
| 4,800,469 | 1/1989 | Leon | 362/200 |
| 4,848,009 | 7/1989 | Rodgers | 36/137 |
| 5,343,190 | 8/1994 | Rodgers | 340/573 |
| 5,406,724 | 4/1995 | Lin | 36/137 |
| 5,408,764 | 4/1995 | Wut | 36/137 |
| 5,419,061 | 5/1995 | Barrocas | 36/137 |
| 5,438,493 | 8/1995 | Tseng | 362/103 |
| 5,463,537 | 10/1995 | Trattner et al. | 362/103 |
| 5,465,197 | 11/1995 | Chien | 362/276 |

FOREIGN PATENT DOCUMENTS

| | | | |
|---|---|---|---|
| 2675025 | 10/1992 | France | 36/137 |

*Primary Examiner*—Denise Gromada
*Assistant Examiner*—Alan B. Cariaso
*Attorney, Agent, or Firm*—Bacon & Thomas

[57] ABSTRACT

A flasher module for footwear includes a main housing containing all necessary circuitry for supplying power to at least one LED and for causing the LED to flash in response to movement of the shoe, except that at least one upper contact is affixed to a press fit cover such that when the press fit cover is secured to the main housing, at least two batteries are sandwiched between the upper contact and a lower contact in the main housing to complete a power supply circuit. The at least two batteries are connected in series, and two additional batteries may also be included in various series and parallel combinations depending on the desired voltage and current. An improved motion sensitive switch includes a terminal member from which a coil spring extends on one side to engage an outer conductive member upon motion of the shoe, the coil spring being soldered to the terminal member on the opposite side from the free end of the spring. The outer conductive member can be semi-cylindrical in form to offer a lower profile and more interesting lighting patterns.

21 Claims, 8 Drawing Sheets

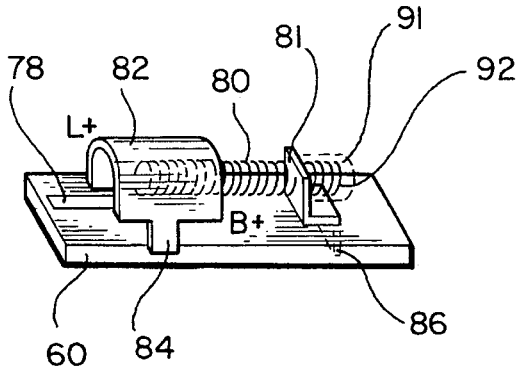
FIG. 3
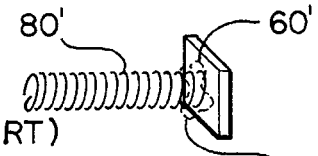
(PRIOR ART)
FIG. 3-1
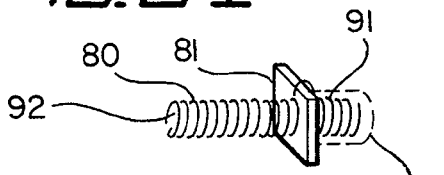
FIG. 3-2
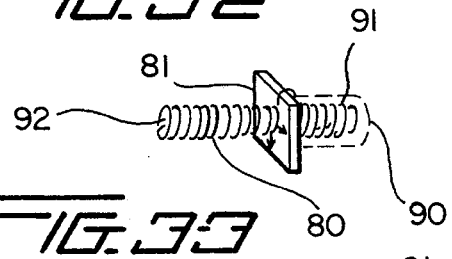
FIG. 3-3
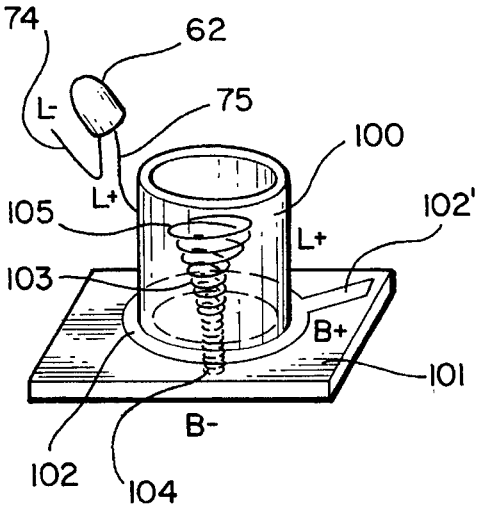
FIG. 4
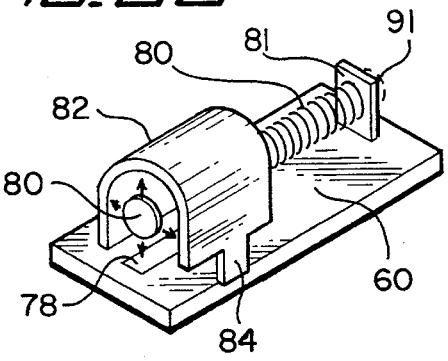
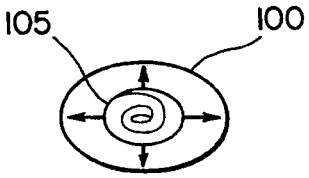
FIG. 4-1
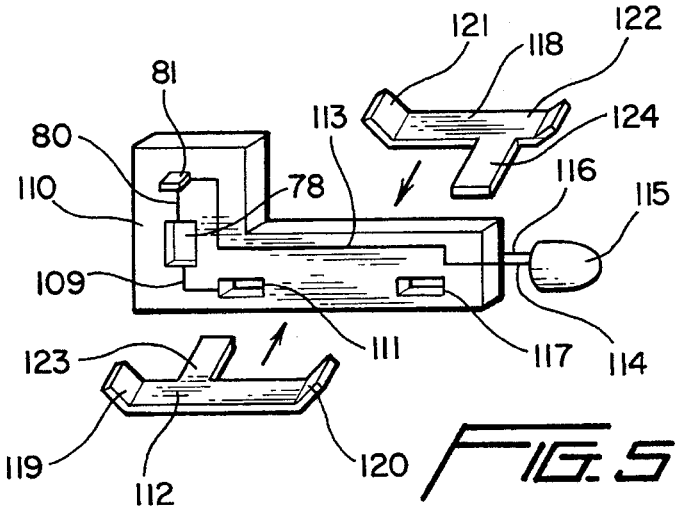
FIG. 5

FLASHING FOOTWEAR LIGHT MODULE

BACKGROUND OF THE INVENTION

1. Field of the Invention

This invention relates to footwear, and in particular to footwear having a "flasher module," i.e., an arrangement for illuminating the shoe in response to movement of the shoe.

2. Discussion of Related Art

Shoes having flasher modules have been commercially available for several years. Generally, such shoes have utilized mercury switches and permanently mounted lithium batteries to provide the flashing effect, but there has been a recent trend to replace at least the mercury switches by safer, less expensive, and less environmentally harmful switching arrangements. Safety, cost, and environmental effects are all significant problems since the most common applications for flasher units of this type are in athletic and children's shoes, which wear out or are outgrown relatively rapidly, and which tend to be subject to greater abuse than other types of shoes. If the electrical units are not exposed during use, they will inevitably become exposed after being discarded, creating a great enough hazard that shoes containing mercury switches have been banned in a number of jurisdictions.

There have been a number of attempts to design safer and less costly flasher units. U.S. Pat. No. 5,408,754, for example, discloses a "motion activated illuminating footwear and light module therefor" in which the sole "improvement" over the prior art involves the replacement of mercury or pressure sensitive switches by a less expensive conventional coil spring actuated switch. Although the light module described in this patent achieves cost savings by using a less expensive switch, the switch used is not as sensitive as a mercury switch, and the system described in the patent still requires a relatively expensive lithium battery, resulting in a light module having substantially decreased performance with minimal overall cost savings.

One reason that the conventional motion sensitive switch, an example of which is illustrated in FIG. 3–1, is less sensitive to vibrations is that the soldering of the switch's inner spring contact to a printed circuit board results in a relatively small vibration angle for the spring contact. The addition of a plastic weight at the end of the spring to increase the inertia of the contact improves electrical engagement between the spring contact and the conductive casing of the switch, but does not increase the vibration angle. Furthermore, the manner in which the spring is soldered to the circuit board makes it likely that solder will be present on the upper portion of the spring, reducing the elasticity of the spring.

Another disadvantage of this arrangement is that the LEDs in this arrangement have one lead soldered directly to the battery, requiring the legs of the LED to be bent during assembly. This has the disadvantage of making assembly without breaking the leads difficult, and also makes it impossible for the user to replace the battery.

Because footwear illumination arrangements such as the one disclosed in U.S. Pat. No. 5,408,764 tend to use non-replaceable soldered-in battery arrangements, the footwear is discarded with the battery when the battery has reached the end of its useful life. Even if the footwear does not outlast the battery, the battery still must be discarded with the shoe. This is not only disadvantageous in terms of cost, but also dangerous to the environment, a problem which is compounded in the case of soldered battery terminals by the problem that most of the batteries are damaged during assembly as a result of the high solder temperatures required (>500° C.), most batteries having been designed to withstand a temperature of no greater than 50° C. While use of a battery bracket can alleviate the problem of heat damage, the problem of irremoveability remains in conventional designs.

Other footwear illumination arrangements are disclosed in U.S. Pat. Nos. 4,848,009, 4,158,922, and 3,893,247, but these arrangements also have the disadvantage of a relatively high cost power source and less than optimal switching arrangements.

SUMMARY OF THE INVENTION

It is accordingly a first objective of the invention to provide a footwear illumination arrangement which utilizes a lower cost power supply by utilizing series-connected sets of low cost batteries in place of a single more expensive battery.

It is a second objective of the invention to provide a footwear illumination arrangement which provides for increased battery life and at the same time lower costs by replacing the single battery of prior designs with multiple series connected battery sets connected in parallel.

It is a third objective of the invention to provide a footwear illumination arrangement which provides for an increased useful life of the footwear by providing for replaceability of the power supply.

It is a fourth objective of the invention to provide a footwear illumination arrangement having an improved motion sensitive switching design for greater sensitivity without significantly increased cost.

It is a fifth objective of the invention to provide a footwear illumination arrangement having improved cushioning for heel installation.

It is a sixth objective of the invention to provide a motion sensitive footwear illumination arrangement having improved sensitive in a low cost and easy-to-assemble package.

These objectives of the invention are achieved, in a first preferred embodiment of the invention, by providing a power circuit for a footwear illumination arrangement which uses a plurality of ordinary button cell batteries, of the type widely used in the digital watch and toy business. The button cell batteries are connected in series in place of the expensive lithium power supplies required in prior designs. While a lithium battery has the advantage of high power (the battery sold by Maxwell Co. of Japan, Model #2032, for example, outputs 200 ma at 3 V), two conventional button style batteries connected in series at 120 ma and 1.5 V are just as effective at one-eighth the cost (a suitable battery is sold as Model LR 1154 by Golden Power Co. of Hong Kong). In fact, by connecting two series-connected battery sets in parallel, a cost savings of 75% can be achieved while greatly increasing the useful life of the device.

In a particularly preferred embodiment of the invention, a footwear light module is provided which includes a housing having a removable press-fit cap from which upper battery contacts depend in such a manner that the batteries are sandwiched between lower battery contacts in the main housing and the upper battery contacts upon placement of the cap or cover on the main housing to complete an electrical power circuit.

In this preferred embodiment of the invention, the upper battery contacts have opposite polarities so as to provide a series output. The batteries are connected to each other by means of a printed circuit board to form sets of parallel connected battery pairs in order to provide a desired current and voltage. For example, using the preferred module, a 3.0 V, 120 ma output can be obtained using two inexpensive 1.5 V, 120 ma batteries, and the current can be increased to 240 ma by using a parallel combination of the batteries.

In addition, the preferred module includes an improved flasher module switching system made up of an at least partially cylindrical outer conductive member and an inner conductive spring contact arranged for movement within the outer conductive member. The inner spring contact is electrically connected to the positive power supply terminal and the surrounding conductive member is electrically connected to the positive terminal of the LED such that when the conductive spring contact engages the surrounding conductive member, a power circuit for the LED is completed and the LED is lit, the coil spring thereby acting as a bridge for the LED current rather than simply as a switch.

In contrast to prior spring actuated motion sensitive switch arrangements, the coil spring contact has a 360° freedom of movement. Preferably, the coil spring of the invention has a narrower base for freedom of movement and an enlarged contact area to provide a larger current carrying capacity. A unique mounting arrangement for the coil spring of the invention prevents solder from adhering to the larger part of the coil and also offers the possibility of coil spring adjustment so that the coil spring will have the same distance to the cylinder wall in all directions.

Additional advantageous features of the invention include the use of both upper and lower spring battery contacts to provide shock absorption features in heel applications, particularly for children's shoes, and the inclusion of a removable cap or cover which is press fit to the main housing by different diameter posts on the bottom and top permits easy assembly.

In the preferred embodiment of the invention, the main housing is arranged to contain all component including the printed circuit board, LEDs, conductive terminals, and batteries, and in addition can also have an optical design or window in front of the LEDs to magnify the light therefrom or include diffraction effects. Preferably, circuitry is included to cause the LED to stay on or flash after activation for a predetermined number of cycles. In addition, the switching system may be replaced by a simple trigger plate.

The invention thus involves an improved electrical circuit which permits greater flexibility in battery selection, an improved motion sensitive switch, and an improved housing and contact arrangement for the batteries, LED, and switch, resulting in a safer, easier to assemble, lower cost "flasher module" having improved flasher performance relative to prior "inexpensive" flasher module designs.

BRIEF DESCRIPTION OF THE DRAWINGS

FIG. 1-A is a schematic circuit diagram showing a variation of the circuit of FIG. 1, in which two pairs of series-connected batteries are connected in parallel.

FIG. 1-B is a schematic circuit diagram showing a further variation of the circuit of FIG. 1, in which two pairs of parallel connected batteries are connected in series.

FIG. 2-1 is a perspective view of the upper housing for the main housing shown in FIG. 2.

FIG. 2-2 is a perspective view of a printed circuit board design for the module of FIGS. 2 and 2-1.

FIG. 3 is a perspective semi-circular switching system design for use in the light module of the first preferred embodiment of the invention.

FIG. 3-1 is a perspective view of a prior mounting arrangement for a coil spring in which the solder is allowed to flow up the spring.

FIG. 3-2 is a perspective view of an improved coil spring mounting arrangement for use in the switching system of FIG. 3.

FIG. 3-3 is a perspective view of a variation of the improved coil spring mounting arrangement shown in FIG. 3-2, in which the position of the coil spring is adjustable.

FIG. 3-4 is a perspective view showing further details of the switching system illustrated in FIG. 3.

FIG. 4 is a perspective view of an alternative switching system for use in the footwear light module of the first preferred embodiment of the invention.

FIG. 4-1 is a top view of the switching arrangement of FIG. 4 showing the ideal location for the coil spring relative to the outer conductive member.

FIG. 5 is a perspective view of a variation of the printed circuit board of FIG. 2-1.

FIG. 7-1 is a perspective view of a completed module made up of the parts shown in FIG. 7.

FIG. 7-2 is a perspective view of a portion of the shown in FIG. 7, including batteries and a printed circuit board.

DETAILED DESCRIPTION OF THE PREFERRED EMBODIMENTS

Figure 1:
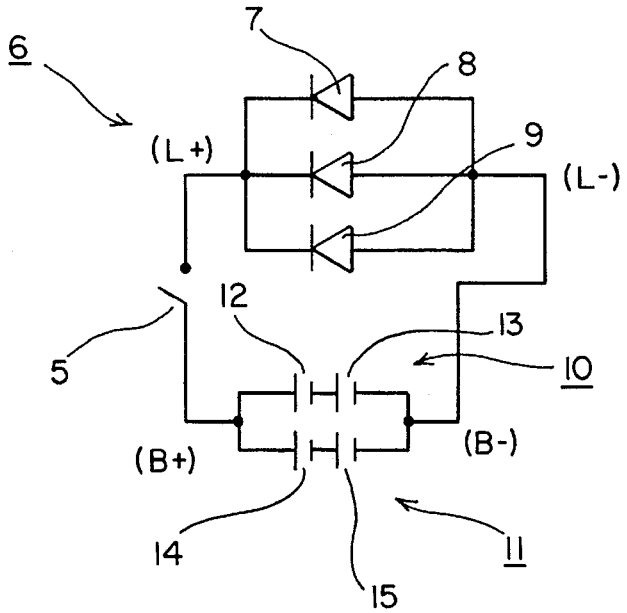
FIG. 1 is a schematic circuit diagram showing an LED activation circuit including two series connected batteries constructed in accordance with a the principles of a first preferred embodiment of the invention.
Figure 1:
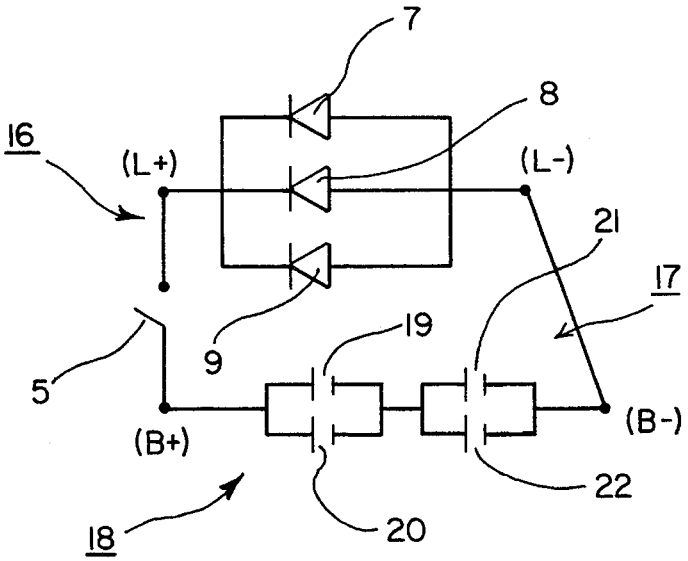
Figure 1:
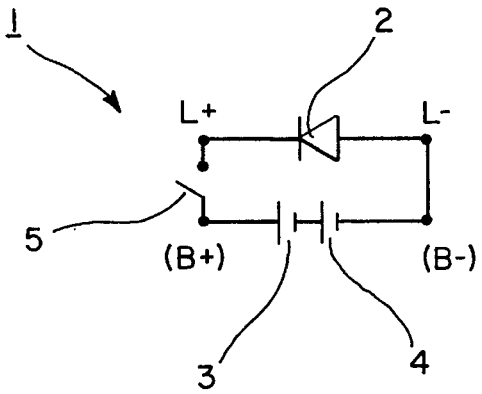

FIG. 1 illustrates an improvement to the conventional lithium battery powered LED driver circuit in which, instead of a single lithium battery, the driver circuit 1 includes an LED 2 powered by two button type dry cell batteries 3 and 4 connected in series with each other and with a switch 5. While it is of course known to connect batteries in series, it is not conventional to connect button type batteries in series, particularly where the voltage and current requirements of the application can be met by a single lithium battery, and thus the present invention is both new and surprisingly advantageous because it turns out that the voltage and current requirements for driving the LEDs can actually be exceeded at less than half the cost of a single lithium battery.

In FIG. 1 and each of the other Figures the collective output of the batteries is designated by terminals B+ and B−, and the respective positive and negative terminals of the LEDs are designated by terminals L+ and L−.

By connecting two series connected battery sets in parallel, a cost savings of 75% over a lithium battery can be achieved while greatly increasing the useful life of the device. For example, using the preferred module, a 3.0 V, 120 ma output can be obtained using two inexpensive 1.5 V, 120 ma batteries, and the current can be increased to 240 ma by using a parallel combination of the batteries. The use of a parallel combination of series connected batteries is illustrated in FIG. 1-A, in which the voltage and current requirements for three parallel-connected LEDs 7–9 are met by providing two sets 10,11 of series connected batteries 12–15 connected in parallel with each other to double the current output without changing the voltage.

While the circuits illustrated in FIGS. 1, 1-A, and 1-B provide an attractive lighting effect with just a motion sensitive switch, it will be appreciated by those skilled in the art that in the case of multiple LEDs, a more complex control circuit could be included, whether using conventional components or an integrated circuit, to vary the activation timing and duration for the various LEDs, some of which could be allowed to flash based on the motion sensitive switch and others based on a predetermined pattern.

In a further variation of the circuit illustrated in FIG. 1, as shown in FIG. 1-B, the voltage and current requirements for the three parallel-connected LEDs 7–9 are met by providing two sets 17,18 of parallel connected batteries 19–22 connected in series with each other.

The footwear light module in which the preferred circuit is used includes a main housing 24 having a base 25 and walls 26–29, cover post receiving openings 30–32, and battery isolation terminals 33 all integrally molded together. The upper housing or cover 38, shown upside-down in FIG. 2-1, in turn includes a plurality of press-fit mounting posts 39–41 having diameters slightly larger than those of openings 30–32 to provide a removable press-fit engagement between the cover and the main housing when posts 39–41 are inserted into openings 30–32, and a pair of upper conductive terminals 42 and 43 fastened to the cover by mounting posts 44–47. The preferred method of fastening the terminals is to stake them onto the mounting posts by inserting the mounting posts through holes in the terminals and melting the ends of the posts to form an expanded section which serves to retain the terminals on the posts, although those skilled in the art will appreciate that numerous other terminal mounting methods may be substituted. As illustrated, the terminals each have battery contact engagement portions 48–51 extending at an angle from the cover so as to bias the batteries in place in the main housing and establish a good electrical connection between both terminals of the batteries and the corresponding terminals or contacts in the housing. A preferred angle for the battery engagement portions is 45°.

The main housing and cover are generally rectangular but asymmetric in that corners 52 and 53 of the rectangle are cut off so that the user does not unintentionally attempt to install the cover and circuit board in an incorrect orientation. In addition, the main housing includes a bay 54 and the base and upper cover include extensions 55 for accommodating the LED 56 of this embodiment. The shape of the housing may of course be varied by those skilled in the art, and a few of the possible variations are shown in connection with the remaining Figures of the present application. Advantageously, bay 54 which must be transparent to permit passage of light from the LED may be shaped to provide optical effects such as dispersion or diffraction of the light as desired.

The circuit board 60 used in this embodiment of the invention is positioned between the front wall 29 of the main housing and the battery isolating posts 33, with the batteries being positioned between the battery isolating posts 33 and the rear and side walls 26–28 of the housing. Included on the circuit board 60 are the motion sensing switch 61, an LED 62, a common negative power terminal 63, and positive power terminals 64 and 65. Preferably, the common negative power terminal 63 is connected to a pair of individual negative contacts 66 and 67, while the positive power terminals are connected respectively connected to individual positive contacts 68 and 69. Contacts 66–68 extend rearwardly from the circuit board 60 when the circuit board is positioned in the main housing such that the contacts extend under the batteries 70–73 (which correspond to batteries 12–15 or 19–22 shown in FIGS. 2 and 3) which are positioned over the contacts by the posts 33, the batteries being biased against contacts 66–68 by respective contact portions 48–51 of the upper contacts, thus providing for easy installation and replacement of the batteries with good electrical contact in an especially compact structure. As illustrated, one lead 74 of LED 62 is connected to the common negative battery terminal 63 on circuit board 60, and the other lead 75 is connected to switch 61. Switch 61 is in turn connected by traces 76 and 77, as shown in FIG. 2-2, to the positive terminals 64 and 65 of the power supply.

Figures 1, 2:
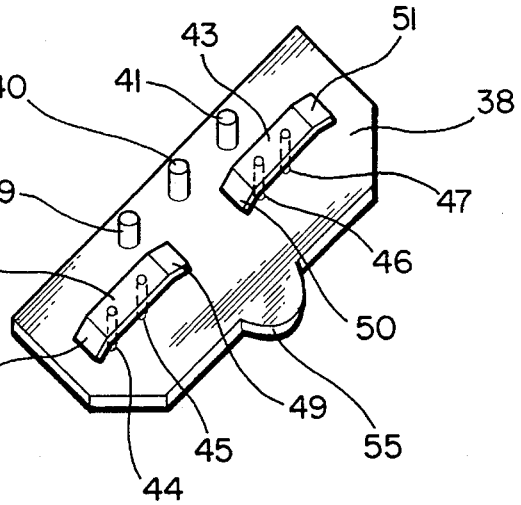
FIG. 2 is a perspective view of the main housing for a footwear light module constructed in accordance with the principles of the first preferred embodiment of the invention.
Figure 2:
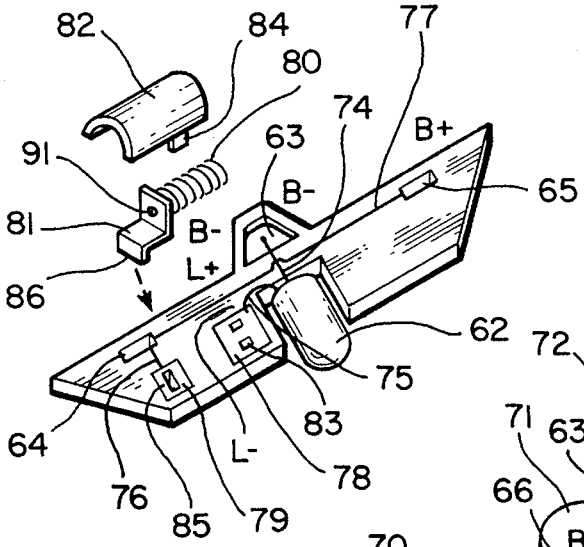
Figure 2:
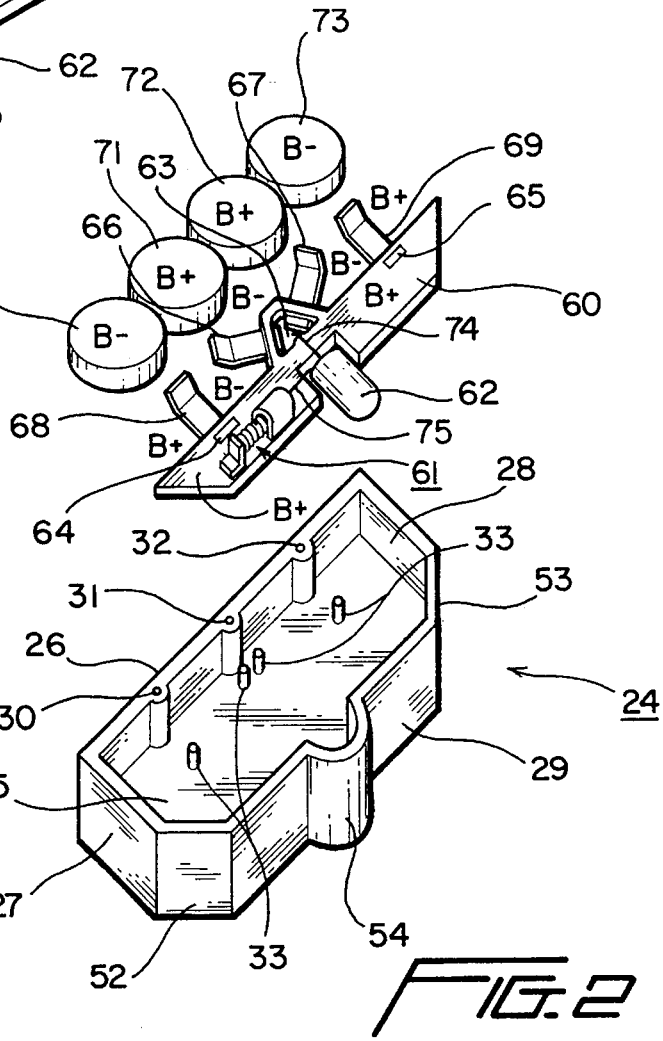

Details of the switch 61 and the manner in which the switch is assembled to the circuit board is shown in greater detail in FIG. 3, 3-2, 3-3, and 3-4, as well as FIG. 2-2. The switch is connected to the circuit board by means of two terminal pads 78 and 79. Lead 75 of LED 62 is soldered to terminal pad 78 and trace 76 is connected to terminal pad 79.

Switch 61 is made up of a coil spring contact 80, a coil spring contact mounting member or bracket 81, and an outer contact member 82. In the embodiment of the invention illustrated in FIGS. 2, 2-2, 3, and 3-4, the outer contact member 82 is semi-cylindrical in shape although the contact could extend through any desired angle up to 360°. The outer contact member 81 is connected to terminal pad 78 by means of slots 83 in the terminal pad and tabs 84 on the contact, although those skilled in the art will appreciate that other suitable electrical connecting means may be used. The terminal pad itself forms, in this embodiment, a part of the outer contact assembly. The coil spring mounting member is similarly mounted, by way of example, on terminal pad 79 by means of slot 85 and tab or extension 86 on the mounting member 81.

The manner in which the coil spring illustrated in FIGS. 3 and 3-2 to 3-4 is mounted provides particular advantages relative to prior art coil spring mounting arrangements involving, as illustrated in FIG. 3-1, directly attaching a coil spring 80' by means of solder 90' to a supporting terminal 60'. This presents the problem that solder is present on the portion of the spring which must bend in response to motion, limiting the motion of the spring. In addition, it is easy to get solder on the distal end of the spring, further stiffening the spring and making it less sensitive motion. In contrast, the present invention provides for attaching, by means of solder 90, an end 91 of the spring to the opposite side of the terminal or mounting member 81 from the moving or free end 92 of the spring. The free portion of the spring, from the terminal to the end is thus unencumbered by any solder, while at the same time it is easier to apply solder to the other side of the terminal 81 without the spread of soldering flux along the coil spring to the free end 92, since the terminal 81 protects the free side of the spring.

As shown in FIGS. 3-3 and 3-4, by making the position of the spring adjustable relative to the mounting member, the spring can be centered within the outer conductive member. To provide the greatest possible range of motion. In addition, those skilled in the art will appreciate that the movement, and therefore the sensitivity, of the coil spring can be controlled by varying the diameter, material, and density of coils of the spring. In this embodiment, the coil spring is not just a switch, but a current bridge. By proper adjustment of coil position and by increasing the radius of the free end of the coil, the current handling capacity of the switch can be maximized, thereby maximizing the brightness of the LEDs powered by the switching circuit. Further, by varying the contact radii, the brightness of the LEDs will vary with the current handling capacity of the contact, creating a less uniform and therefore more interesting lighting effects.

In a modification of the switch shown in FIGS. 3 and 3-2 to 3-4, the motion sensitive switching arrangement includes an outer conductive member in the form of a complete cylinder 100 which is vertically positioned on a circuit board 101, which may be similar to circuit board 60. In this arrangement, which is illustrated in FIG. 4, the positive lead 75 of one or more LEDs 62 may be directly connected to the cylinder 100 or to an annular trace 102 on which the cylinder is positioned, the annular trace 102 being connected by trace 102' to the positive terminal of the battery.

The motion sensitive coil spring 103 in this embodiment extends all the way through the circuit board such that an end 104 of the spring 103 extending through to the opposite side of the circuit board can be soldered thereto without affecting its movement on the switching side, with the negative terminal of the battery being connected to the soldered end of the spring 103. The use of a complete cylinder, as indicated in FIG. 4-1, permits a uniform flashing effect as opposed to the more varied effect achieved by the semi-cylindrical design, with control of the flashes being obtained by varying the diameter of the free end 105 of the spring 103.

Figure 6:
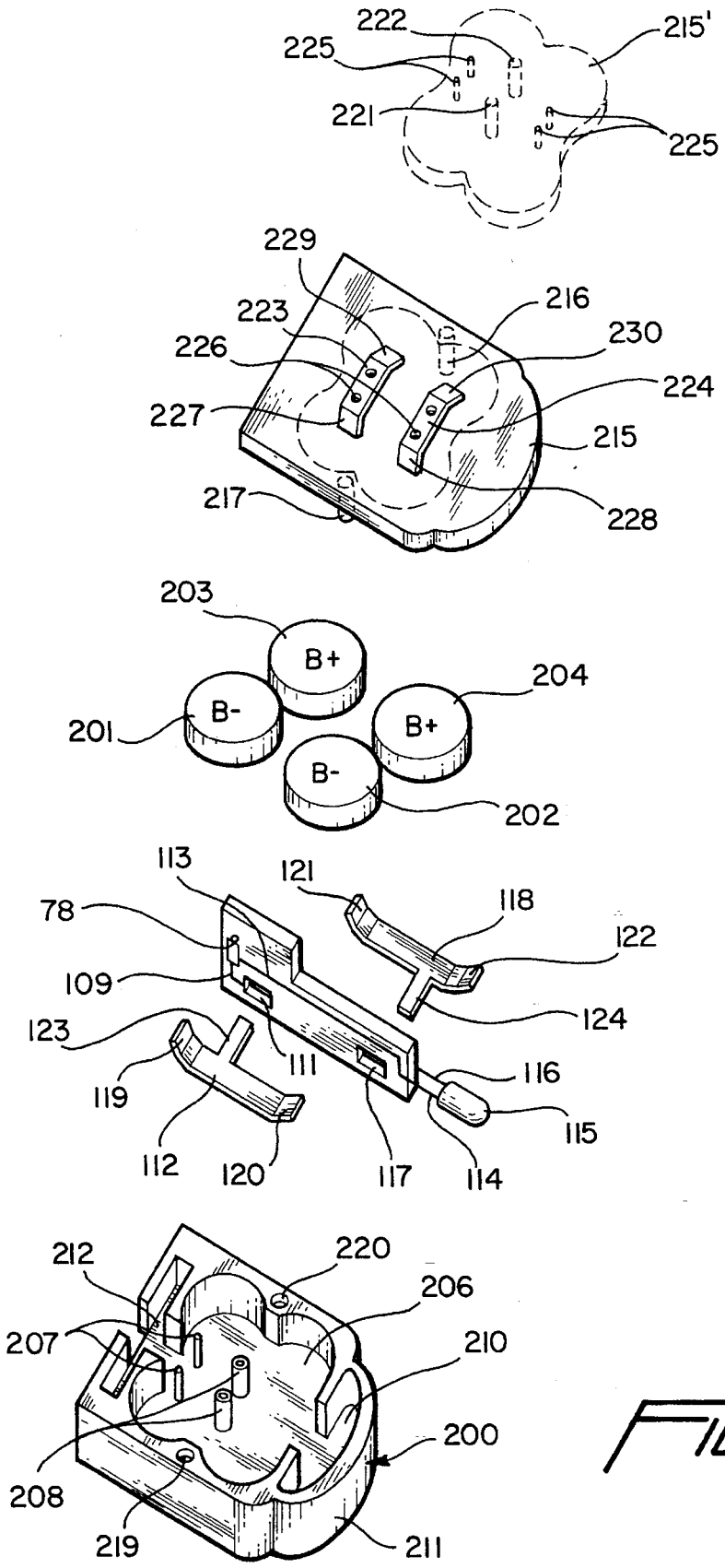
FIG. 6 is an exploded perspective view of a variation of the footwear light module shown in FIG. 2.

FIGS. 5 and 6 illustrate an alternative version of the light module of FIG. 4. In this version, the circuit board is in the form of a L-shaped member 110, with one side having printed thereon a positive voltage trace 109 extending from a terminal 111 arranged to receive a first battery contact 112, contact 112 being arranged to contact the positive terminal of a battery and ending at the terminal pad 78 of a switch corresponding to that shown in FIG. 3, the opposite side of the switch being further connected by a positive trace 113 to the positive voltage lead 114 of an LED 115. In this version of the preferred embodiment, the negative lead 116 of the LED extends along the opposite side of the circuit board to a negative contact terminal 117 arranged to receive a negative battery contact 118. Both the positive and negative battery contacts 112 and 118 including battery engagement sections 119–121 extending at an angle of, for example, 45° from the main section of the contacts to provide a biasing force which ensures a good electrical connection between the contacts and the battery terminals. Connection to the circuit board member 110 is by means of tabs 122,123 on the contacts which extend into the slots which form terminals 111,117.

The circuit board arrangement shown in FIG. 5 is used in connection with the module arrangement illustrated in FIG. 6. As with the embodiment of the invention illustrated in FIGS. 2 and 2-1, the module of this embodiment includes a main housing 200 in which the circuit board 110, LED 115, and batteries 201–204 are accommodated. To this end, the main housing 200 includes a main compartment having posts 207 extending thereinto for supporting the circuit board, and posts 208 for also supporting the circuit board, with the circuit board thereby dividing the compartment 206 into a two sections with batteries 201 and 202 on one side and batteries 203 and 204 on the other, the positions of the batteries being further established by curved portions 209 of the outer wall of the main housing. Optionally, posts 208 may also serve to receive press fit pins extending from the cover, as will be explained below.

When the circuit board of FIGS. 5 and 6 is positioned in the compartment 206 by means of posts 207 and 208, LED 115 will extend into an opening 210 having a transparent wall 211 which can be shaped to provide optical effects if desired. The contacts 112 and 118, which have been pre-soldered to terminals 111 and 117 extend on opposite sides of the board with batteries 201–204 being place on top of the contacts such that the positive terminals of batteries 201 and 202 engage respective angled portions of contact 112, and the negative terminals of batteries 203 and 204 engage respective angled portions of contact 118. A rear compartment 212 of the main housing serves to accommodate leads for connecting addition LEDs to the switching circuit.

As shown in FIG. 6, the main housing 200 can accommodate two different press-fit covers 215 and 215', the difference being that cover 215 is press-fit by means of pins 216 and 217 to respective openings 219 and 220 in the outer wall of the housing, and alternative cover 215' is press-fit by means of pins 221 and 222 and posts 208. Each of the alternative covers shares, however, upper battery contacts 223 and 224, which are preferably secured to the covers by mounting pins 225 staked to openings 226 in the contacts, with angled sections 227 and 228 of contacts 223 and 224 being respectively arranged in the illustrated example to engage the negative terminals of batteries 201 and 202, and angled sections 229 and 230 of contact 118 being respectively arranged to engage the positive terminals of batteries 203 and 204, thereby forming a circuit similar to that illustrated in FIG. 1-A.

Figure 7:
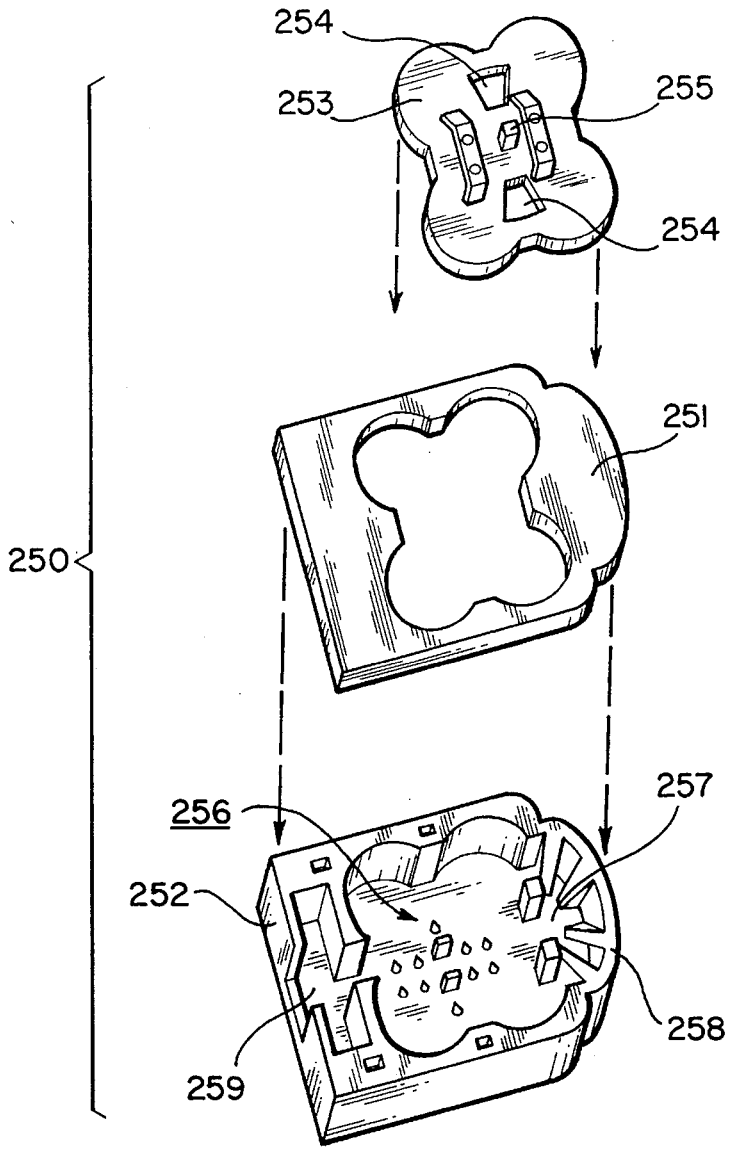
FIG. 7 is an exploded perspective view of a further variation of the footwear light module shown in FIG. 2.
Figures 1, 7:
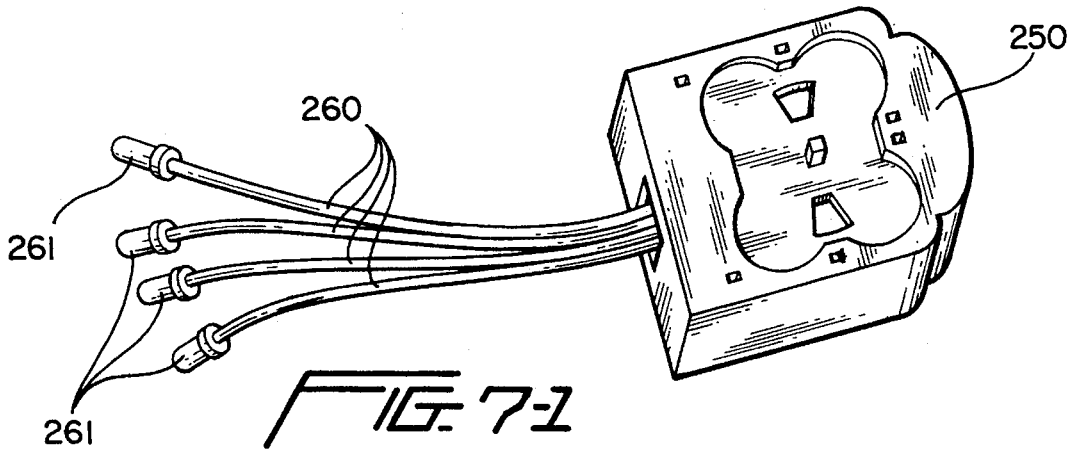
Figures 2, 7:
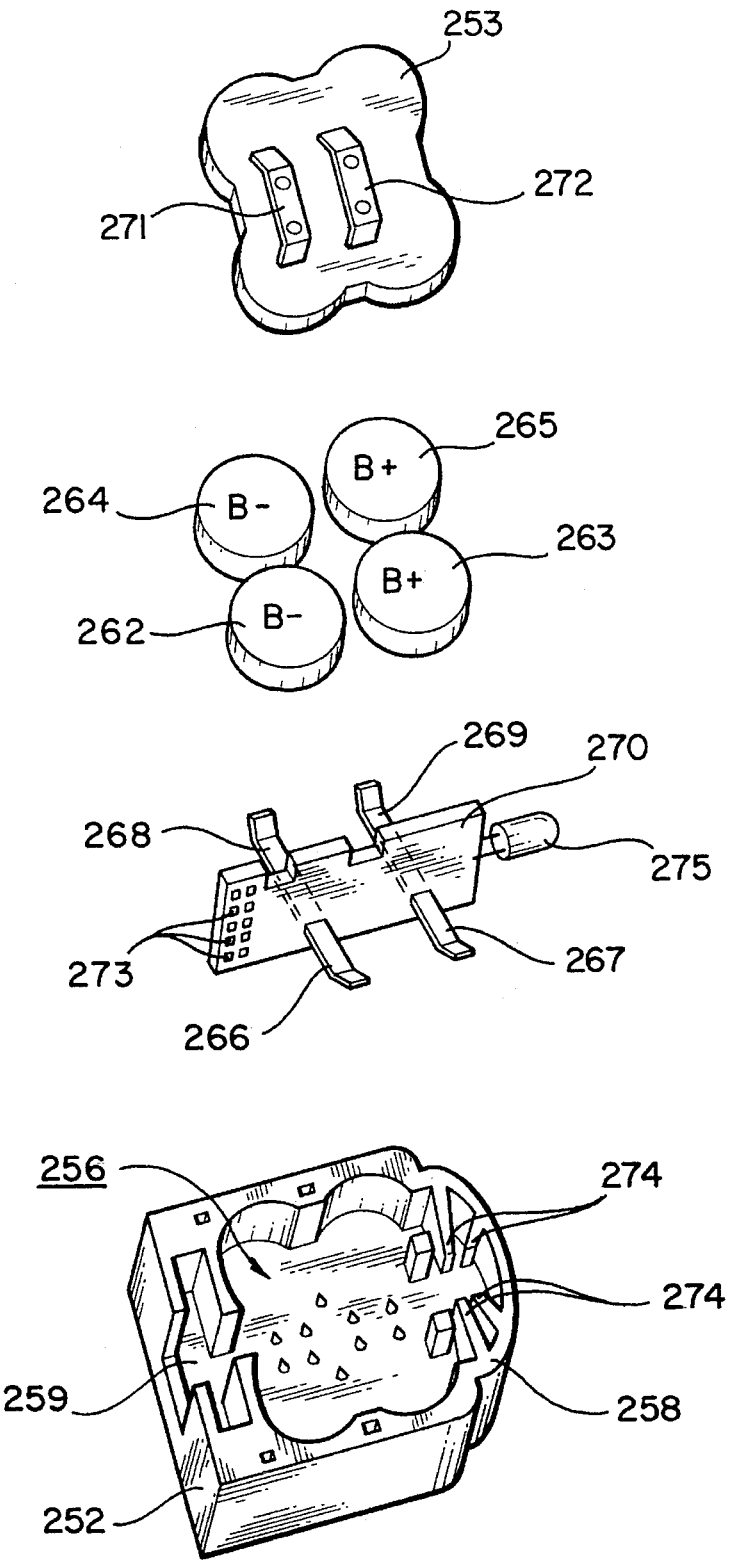

The variation of the preferred embodiment illustrated in FIGS. 7 to 7-2 uses a cover made up of a protective member 251 permanently secured to the main housing 252 and a removable press-fit cap 253 having openings 254 through which the user can insert the tip of a pen or the like in order to facilitate removal of the cap. In this embodiment, cap 253 includes a press fit pin 255, while the battery compartment includes various molded-in posts 256 for positioning a circuit board of the type illustrated in FIG. 5, positioning and isolating the batteries from each other and the circuit board, and cooperating with the press-fit pin 255. In addition, the main housing 252 of this embodiment also includes a compartment 257 for accommodating the LED, the compartment including a transparent wall 258, and a compartment 259 for accommodating external LED leads 260 of optionally multi-colored LEDs 261 and permitting their connection to the circuit board.

The additional posts 256 extending from the base of the main housing in this embodiment are provided because the batteries 262–265 are supported by four separate lower contacts 266–269 extending from opposite sides of the circuit board 270 rather than the common contacts of the embodiment illustrated in FIG. 6. By positioning the batteries such that the lower contacts on each side of the board respectively engage one positive and one negative terminal, and the upper contacts 271 and 272 engage common negative and positive contacts of the batteries, a circuit such as the one in FIG. 1-B can be obtained. Additional modifications provided by this embodiment of the invention include the provision at one end of the circuit board of a plurality of terminals 273 for accommodating the leads 260, and the inclusion in the main housing of molded-in structures 274 for supporting LED 275.

Figure 8:
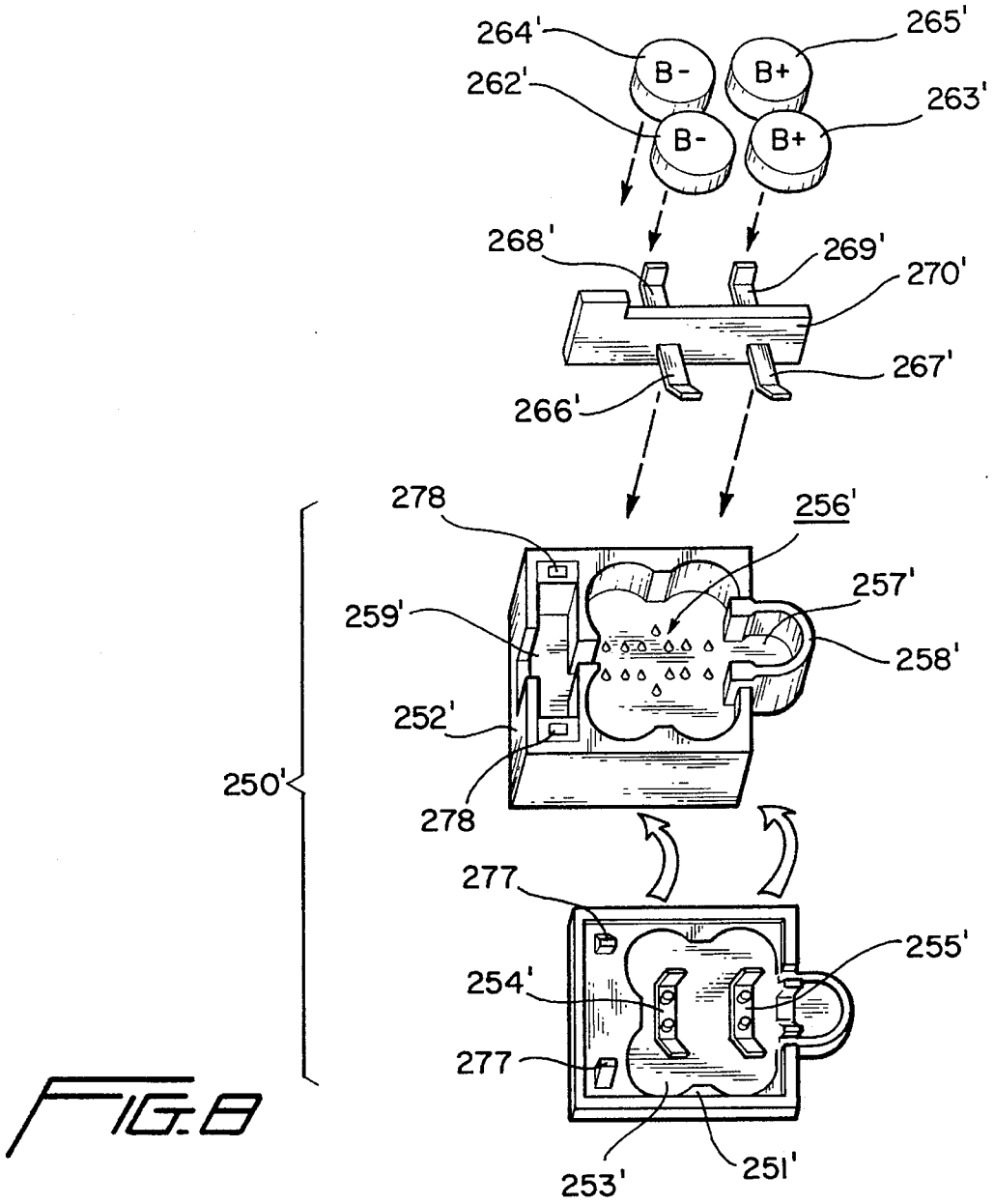
FIG. 8 is an exploded perspective view of yet another variation of the footwear light module shown in FIG. 2.
Figures 1, 8:
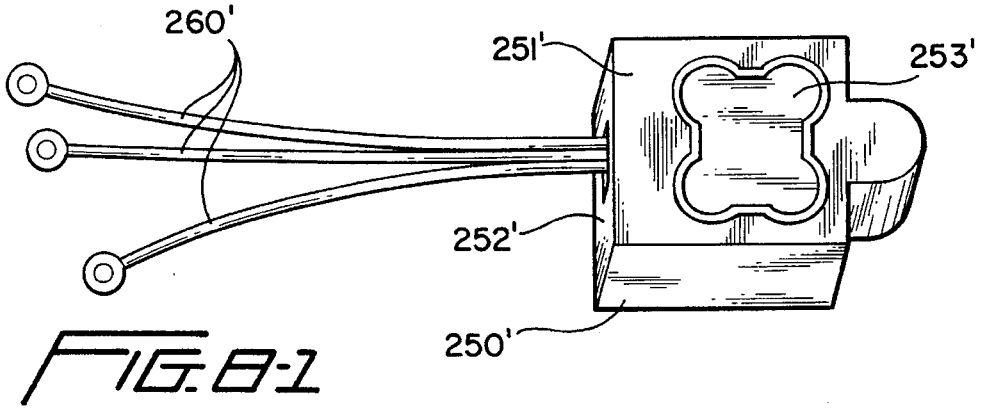

The arrangement shown in FIG. 8 is identical to that shown in FIGS. 7 to 7-2, except for the shapes of the housing and cover, and the location of the press-fit pins 277 and openings 278. Corresponding elements have therefore been designated by primed reference numerals and the details of the construction of this module are not discussed further herein.

Figure 9:
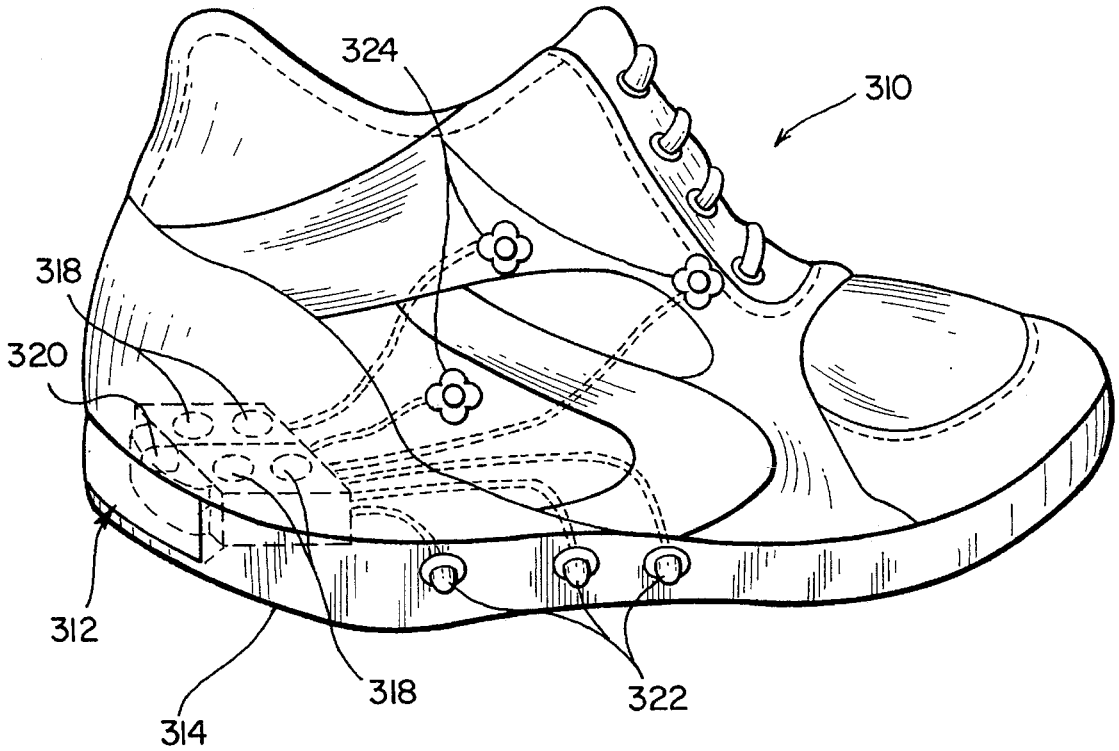
FIG. 9 is a perspective view of a shoe which includes a footwear light module constructed according to the principles of the first preferred embodiment of the invention.
Figure 10:
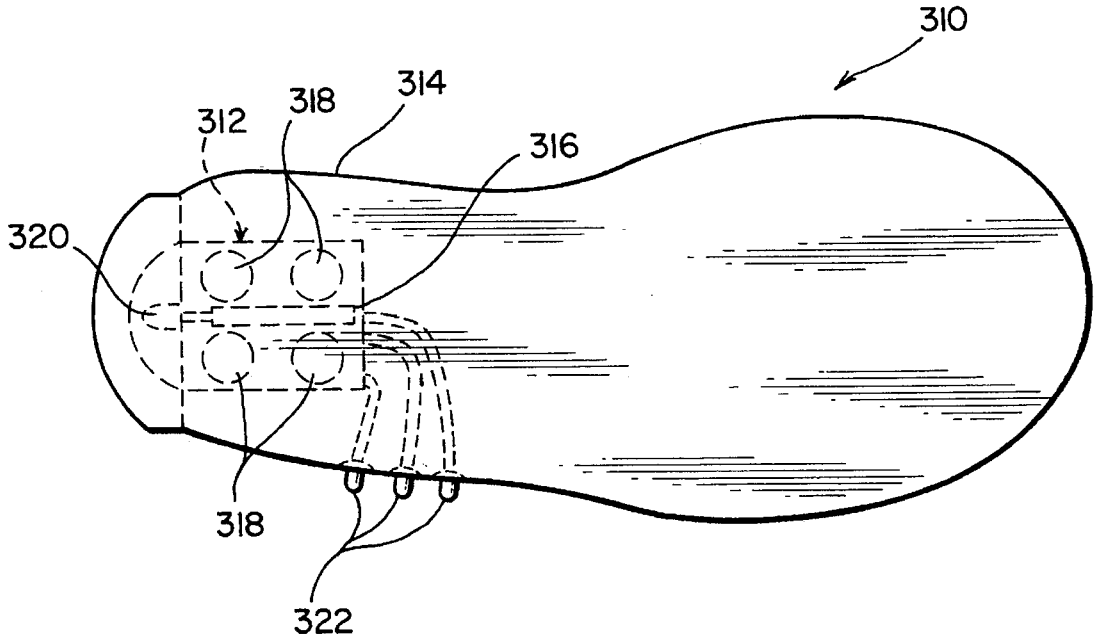
FIG. 10 is a bottom view of the shoe of FIG. 9.

Finally, FIGS. 9 and 10 show an application of the flasher modules of any of the preferred embodiments of the invention to a shoe, and in particular to the heel 314 of a shoe 310. In this Figure, the flasher module is designated by the reference numeral 312, the circuit board by reference numeral 316, the batteries by reference numeral 318, the LED contained in the module by reference numeral 320, and additional multi-colored LEDs by reference numerals 322 and 324. Those skilled in the art that flasher module 312 of this embodiment could be represented by any of the flasher modules shown in 2-8, and that the flasher modules of the preferred embodiments of the invention could be used in a variety of footwear and other applications.

Having thus described various preferred embodiments of the invention, those skilled in the art will appreciate that variations and modifications of the preferred embodiment may be made without departing from the scope of the invention. It is accordingly intended that the invention not be limited by the above description or accompanying drawings, but that it be defined solely in accordance with the appended claims.

We claim:

1. A flasher module for footwear, comprising:

a main housing;

a removable cap, means for removably attaching the removable cap to the main housing, and at least one upper battery contact affixed to the removable cap and depending from the removable cap;

a printed circuit board positioned in the main housing and including conductive traces on a surface thereof;

a lower battery contact positioned in the main housing and connected to one of said traces;

at least two batteries sandwiched between the upper and lower battery contacts and electrically connected to each other by at least the upper battery contact when the removable cap is secured to the main housing;

a light emitting diode; and a motion sensitive switch including a first conductive member connected by one of said traces to said lower battery contact and a second conductive member connected by one of said traces to the light emitting diode, wherein one of said first and second conductive members is a spring and another of said first and second conductive members is fixed relative to the circuit board, said spring being positioned to intermittently contact said fixed conductive member when said module is moved to thereby cause said at least two batteries to be intermittently connected to said light emitting diode.

2. A flasher module as claimed in claim 1, wherein said two conductive members of the motion sensitive switch are installed on said circuit board.

3. A flasher module as claimed in claim 2, further comprising a second lower contact connected to a common circuit board terminal with the first lower contact.

4. A flasher module for footwear, comprising:

a main housing;

a removable cap, means for removably attaching the removable cap to the main housing, and at least one upper battery contact affixed to the removable cap and depending from the removable cap;

a printed circuit board positioned in the main housing and including conductive traces on a surface thereof;

a lower battery contact positioned in the main housing and connected to one of said traces;

at least two batteries sandwiched between the upper and lower battery contacts and electrically connected to each other by at least the upper battery contact when the removable cap is secured to the main housing;

a light emitting diode; and a motion sensitive switch including a first conductive member connected by one of said traces to said lower battery contact and a second conductive member connected by one of said traces to the light emitting diode, wherein one of said first and second conductive members is a spring and another of said first and second conductive members is fixed relative to the circuit board, with said spring being positioned to intermittently contact said fixed conductive member when said module is moved and thereby cause said at least two batteries to be intermittently connected to said light emitting diode, and further comprising a coil spring mounting bracket, wherein said spring is a coil spring and the the fixed conductive member is an at least partially cylindrical outer conductive member, a first portion of said coil spring extending from one side of said coil spring mounting bracket and a second portion extending from a second side, and wherein the first portion has a free end arranged to intermittently contact said outer conductive member to close a power supply circuit to said light emitting diode and the second portion is soldered to the mounting bracket, said mounting bracket limiting a spread of soldering flux along the coil spring.

5. A flasher module as claimed in claim 4, wherein said mounting bracket includes means for enabling adjustment of a position of the coil spring relative to the outer conductive member.

6. A flasher module as claimed in claim 5, wherein said outer conductive member is semi-circular in shape and mounted on the circuit board in such a manner that the terminal on which the outer conductive member is mounted serves as part of a switch outer contact to increase an angle of sensitivity of the switch while maintaining a low profile.

7. A flasher module as claimed in claim 1, wherein said fixed conductive member is a conductive cylinder mounted on the circuit board, and said spring is a coil spring extending through said circuit board and soldered to a side of said circuit board opposite a side on which the conductive cylinder is mounted to prevent soldering flux from spreading along the coil spring on a conductive cylinder side of the circuit board.

8. A flasher as claimed in claim 1, wherein the light emitting diode is mounted inside the main housing, the main housing including a transparent portion through which light emitting diode is visible, and wherein leads of the light emitting diode are mounted on the circuit board.

9. A flasher as claimed in claim 1, comprising means for connecting lead wires from a plurality of light emitting diodes to said circuit board.

10. A flasher module as claimed in claim 1, wherein a plurality of light emitting diodes are powered by said batteries and an integrated circuit is included on said circuit board to control an activation timing and duration of said plurality of light emitting diodes.

11. A flasher module as claimed in claim 1, wherein said upper battery contact is staked to the removable cap.

12. A flasher module as claimed in claim 1, wherein said upper battery contact includes extensions for contacting a positive terminal of one of said batteries and a negative terminal of the other of said batteries.

13. A flasher module as claimed in claim 1, wherein said removable cap includes openings through which an object may be inserted to facilitate removal of the removable cap and replacement of said batteries.

14. A flasher module as claimed in claim 1, wherein said upper and lower contacts are resilient to provide a cushioning effect.

15. A flasher module as claimed in claim 14, wherein said removable cap is mounted on the housing by means of pins and openings for receiving said pins.

16. A flasher module as claimed in claim 1, wherein said main housing has a transparent portion to allow passage of light from an LED positioned within said main housing.

17. A flasher module as claimed in claim 1, wherein said flasher module is installed in a heel of a shoe.

18. A flasher module as claimed in claim 1, wherein said flasher module is arranged to position the light emitting diode inside a heel of a shoe, on an outside of the shoe, and on an upper portion of the shoe.

19. A flasher module as claimed in claim 1, wherein said batteries are 1.5 V button-type batteries.

20. A flasher module as claimed in claim 19, wherein a number of said batteries is four, said batteries forming two sets of series connected batteries, said two sets being connected in parallel with each other.

21. A flasher module as claimed in claim 19, wherein a number of said batteries is four, said batteries forming two sets of parallel connected batteries, said two sets being connected in series with each other.

* * * * *